US008427340B2

(12) United States Patent
Palmieri

(10) Patent No.: US 8,427,340 B2
(45) Date of Patent: Apr. 23, 2013

(54) MULTI-MODE SAFETY SYSTEM FOR SPOTTER-ASSISTED VEHICLE MANEUVERING

(75) Inventor: Jovan Palmieri, Elk River, MN (US)

(73) Assignee: Jovan Palmieri, Elk River, MA (US)

( * ) Notice: Subject to any disclaimer, the term of this patent is extended or adjusted under 35 U.S.C. 154(b) by 205 days.

(21) Appl. No.: 12/963,381

(22) Filed: Dec. 8, 2010

(65) Prior Publication Data

US 2011/0133951 A1 Jun. 9, 2011

Related U.S. Application Data

(60) Provisional application No. 61/267,605, filed on Dec. 8, 2009.

(51) Int. Cl.
*G08G 1/00* (2006.01)

(52) U.S. Cl.
USPC ..... 340/901; 340/902; 340/435; 340/686.5; 340/692; 340/691.6

(58) Field of Classification Search ..... 340/435, 340/901, 902, 686.5, 686.6, 692, 426.14, 340/691.6
See application file for complete search history.

(56) References Cited

U.S. PATENT DOCUMENTS 3,944,972 A * 3/1976 Chandler ..... 340/425.5
7,567,167 B2 * 7/2009 Oelrich et al. ..... 340/435
7,777,617 B2 * 8/2010 Oelrich et al. ..... 340/435
7,834,758 B2 * 11/2010 Peterson et al. ..... 340/539.11
8,013,720 B2 * 9/2011 Oelrich et al. ..... 340/435
8,144,030 B1 * 3/2012 Lipke ..... 340/908
2002/0084912 A1 * 7/2002 Stefanik ..... 340/825.69
2006/0092623 A1 * 5/2006 Irisawa ..... 362/102
2008/0157999 A1 * 7/2008 Koutari ..... 340/825.25
2008/0258932 A1 * 10/2008 Oelrich et al. ..... 340/901
2010/0271235 A2 * 10/2010 Oelrich et al. ..... 340/901

OTHER PUBLICATIONS

Reverse Control, Inc.; Prevent Backing Accidents, Frequently asked questions part 1, www.reversecontrol.com, 1 page, dated Oct. 1, 2009.
Reverse Control, Inc., Frequently asked questions part 2, www.reversecontrol.com, 1 page, dated Oct. 1, 2009.
Reverse Control, Inc., Reverse Control System Specifications, www.reversecontrol.com, 1 page, dated Oct. 1, 2009.
Reverse Control, Inc., System Components and Operation, www.reversecontrol.com, 1 page, dated Oct. 1, 2009.

* cited by examiner

*Primary Examiner* — Hoi Lau
(74) *Attorney, Agent, or Firm* — Thompson Patent Law Offices PC; Craige Thompson

(57) ABSTRACT

Apparatus and associated methods involve a handheld illuminated module to communicate safety information from a spotter to a driver during a vehicle maneuver. In an illustrative example, the spotter operates the module at a position from which to monitor a region in the vehicle's path. The spotter communicates to the driver that the path is clear by depressing a switch on the module. When depressed, the module switch indicates a "safe" mode that (1) illuminates the module, for example, with a green color, and (2) communicates to a vehicle safety module (VSM) on-board the vehicle. In response to the message, the VSM may transition from a warning mode to a safe mode and emit corresponding visual and/or audio signals to the driver. If the spotter releases the switch, the module illumination changes, and the VSM reverts to warning mode in which it prompts the driver to stop the vehicle.

24 Claims, 8 Drawing Sheets

MULTI-MODE SAFETY SYSTEM FOR SPOTTER-ASSISTED VEHICLE MANEUVERING

CROSS-REFERENCE TO RELATED APPLICATIONS

This application claims priority to U.S. Provisional Patent Application entitled "Illuminated System for Spotter-Assisted Vehicle Maneuvering," Ser. No. 61/267,605, which was filed by Jovan Palmieri on Dec. 8, 2009, the entire disclosure of which is incorporated herein by reference.

TECHNICAL FIELD

Various embodiments relate generally to apparatus or methods for improving safety during vehicle maneuvers.

BACKGROUND

Every year, tragic deaths, serious injuries, and substantial property damage occur when backing vehicles. While the speeds involved may be much lower than forward operation, driver visibility and depth perception may be significantly obscured by the physical size and viewing angles available to the driver, particularly when the driver is located at a substantial distance from the back of the vehicle.

Large motor vehicles serve many functions in modern society. For example, emergency crews may operate fire trucks, ambulances, and other rescue vehicles to and from locations where they are needed to perform various emergency response functions. Professional drivers operate semi-trailer trucks or a delivery van in a fleet, for example, to deliver goods or services to their destinations. As a further example, non-commercial large vehicles, such as mobile homes or other recreational vehicles, may be driven between residential and remote locations. As further examples, garbage and recycling pick-up trucks operate in residential areas, and construction vehicles, such as dump trucks or cement trucks, operate in or around road or building construction sites.

In many situations, large motor vehicles make backing maneuvers at certain locations. At a fire station, for example, fire trucks may back into a parking position between other vehicles and/or fire station structures, such as a garage door pillar. At an emergency site, emergency vehicles may need to perform backing maneuvers to access a fire hydrant, for example. A rescue helicopter may need to land within a makeshift area near a highway crash site. At a construction site, large vehicles may need to back into a desired position from a specified direction to load supplies and equipment. In an alley, a garbage truck may perform backing maneuvers during its route.

While backing a large vehicle, the large vehicle operator may have little or no visibility in some or all of the immediate zone in the path of the backing vehicle. The size and features of the vehicle may substantially obscure the driver's view of people or objects in the vehicle's path. In some circumstances, visibility may be further limited by unfavorable lighting conditions and/or unfamiliar terrain. Ambient and/or vehicle noise, for example, may further complicate the driver's ability to detect dangerous conditions that may develop behind the backing vehicle. In some cases, radio links may not provide sufficient access to rapidly communicate safety information to a driver. For example, crowded radio channels may cut-off the ability of a spotter to "break-in" to a channel to notify a driver of a hazard when a hazard is detected.

Various published accounts suggest that backing of large vehicles can pose significant risks to both personnel and property. For example, citizens and/or fire crew personnel may be present in or near the path of a backing emergency vehicle.

In addition to safety for people, some vehicle backing operations can involve risks for potentially expensive equipment or property damage. For example, the consequences of a mishap while backing a helicopter into a hangar may include the potential for costly damage assessment and/or repair if the rotor blades impact the hangar structure.

SUMMARY

Apparatus and associated methods involve a handheld illuminated module to communicate safety information from a spotter to a driver during a vehicle maneuver. In an illustrative example, the spotter operates the module at a position from which to monitor a region in the vehicle's path. The spotter communicates to the driver that the path is clear by depressing a switch on the module. When depressed, the module switch indicates a "safe" mode that (1) illuminates the module, for example, with a green color, and (2) communicates to a vehicle safety module (VSM) on-board the vehicle. In response to the message, the VSM may transition from a warning mode to a safe mode and emit corresponding visual and/or audio signals to the driver. If the spotter releases the switch, the module illumination changes, and the VSM reverts to warning mode in which it prompts the driver to stop the vehicle.

In accordance with an illustrative example, the VSM may be responsive to an angle at which the spotter holds a wand. For example, in a safe mode, when the spotter holds a selected axis of the wand in a substantially vertical orientation, the VSM and/or wand illumination may emit a first display (e.g., constant green) to indicate to the driver that the path is clear to back up straight. When the spotter rotates the selected axis clockwise or counterclockwise, the VSM and/or wand illumination may emit a second display (e.g., flashing toward right) or a third display (e.g., flashing toward left) to indicate to the driver that the path is clear to back up in a right or left turn, respectively. In some implementations, the indicator signals communicated to the driver may be modulated based on the angular position, and/or angular velocity, or acceleration trajectory of the wand.

Some embodiments may include more than one handheld module in operative communication with the vehicle safety module. In some examples, each wand in operative communication may be illuminated in response to a state of a different wand.

Some systems may include a charging station to transfer energy from the vehicle into an energy storage system on one or more handheld modules. The charging station may include an electrical interface to make releasable galvanic connection. In another embodiment, the charging station may include one or more receptacles. Each receptacle may be adapted to receive and releasably retain a corresponding handheld module. In further embodiments, power and data may be transferred via contactless interfaces to and from the handheld modules. In some examples, power transfer may be inductively coupled to a charging module for storage in the handheld module. Some embodiments may receive and/or transmit digitally encoded information through an optical data port.

Various embodiments may achieve one or more advantages. For example, some embodiments may improve safety information communications between one or more spotters and a vehicle driver executing a vehicle backing maneuver. Exemplary systems may advantageously provide enhanced safety for personnel and property by illuminating the handheld wand to help the driver see the wand, for example, even under poor or adverse lighting, visibility. In some implementations, confusion as to the spotter's identity or as to how to interpret voice or hand signals may be substantially reduced or avoided by communicating a stop signal to the driver unless each spotter actively operates and orients their handheld wand according to predetermined criteria. Various implementations may improve the reliability and response time of safety communications from a spotter to the driver using multiple modes, which may include (1) illuminated wand with color code (e.g., red, green) visibly held by spotter, (2) a visual display channel, (3) an alarm channel, and/or (4) a voice channel. In some examples, visual communication may include one or more visual and/or audio signaling devices to rapidly communicate clearly discernible safety information to the driver under any of a variety of lighting, visibility, and ambient noise conditions. In some examples, exemplary systems may promote improved face-to-face communication (e.g., discuss a backing plan) between the driver and one or more spotters as the driver passes a wand to each spotter. Some embodiments may substantially reduce confusion and/or delay during, for example, backing of emergency vehicles, which may substantially reduce response times without compromising safety of personnel and property. According to some implementations, cost and/or liability for injuries and property damage from vehicle backing accidents may be substantially reduced by substantially reducing the risk of accidents. Some implementations may electronically record system events and vehicle backing operations, and may further record time stamped data, for example, to advantageously provide improved incident report information, or promote compliance with safety programs through auditing of system logs.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

FIG. 1 shows a perspective view of an exemplary backing operation being performed with an exemplary vehicle maneuver communication system (VMCS) including an illuminating spotter wand. The depicted figure shows a VMCS 100 that includes a vehicle-mounted sub-system (VMSS) 105 to receive communications with safety information from an illuminating handheld spotter module (HHSM) 110. In various embodiments, a spotter in position to view a zone in the path of vehicle travel may operate the spotter module 110 to communicate safety signals in a mode readily visible to a driver of the vehicle. Specifically, the HHSM 110 includes a light module 115 to project visible-mode communication signals to enhance delivery of safety information between the spotter and the driver before, during, or after a vehicle maneuver. In various embodiments, the illumination of the light module 115 may provide high visibility signals in the driver's field of view that may reliably and substantially improve the speed and safety to life and property during vehicle maneuvers, for example, under a wide range of conditions (e.g., noise, weather, visibility, and lighting). As will be described below, various examples may incorporate safety signals capable of being substantially instantly interpreted and/or substantially universally understood under a wide range of stressful circumstances (e.g., emergency vehicle maneuver in urgent response to fire and/or medical emergencies in adverse weather at night).

The HHSM 110, which will be described in further detail with reference to FIG. 4, includes a grip and a safety state control switch (SSCS). In operation, the HHSM 110 may, in some embodiments, be in an inactive or "unsafe" state unless the spotter positively actuates (e.g., depresses or slides) the SSCS. While the spotter is positively actuating the SSCS (e.g., by holding the SSCS in an actuated position), the HHSM 110 may enter a "safe" state. In an exemplary safe state, the light module 115 may be illuminated with a first color and/or pattern of illumination which may be readily detected by the driver. By way of example and not limitation, the first color may include a green spectrum that can be readily distinguished from a non-safe state color, such as red, for example. When the spotter releases the SSCS, the SSCS is biased to return to its deactuated state, and the HHSM 110 and VMSS 105 in turn transition back to the unsafe state, and the illumination of the HHSM 110 reverts to a color (e.g., red) and/or pattern indicating the unsafe state.

Figure 1A:
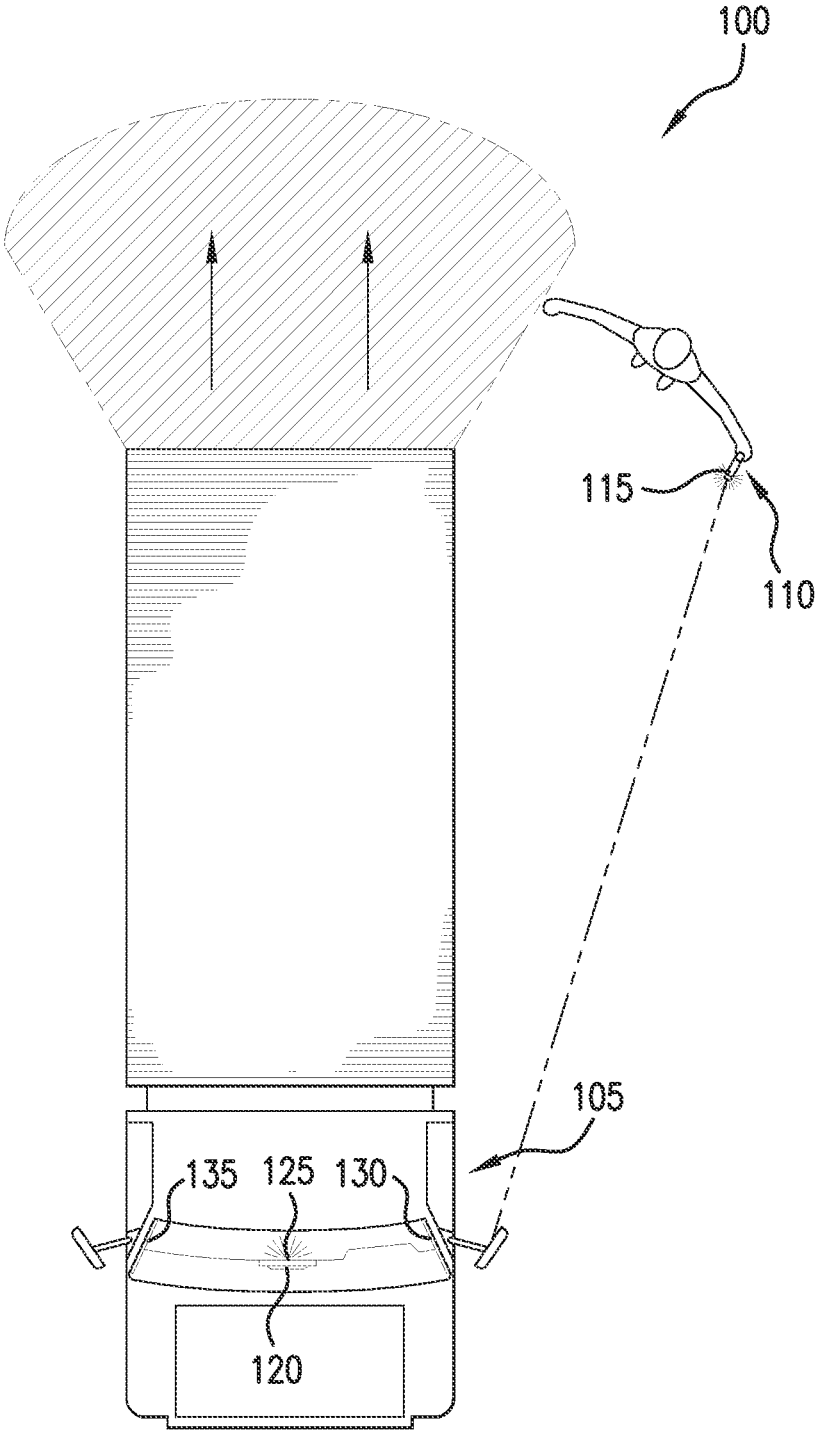
FIGS. 1A-1B show top and side perspective views of a vehicle backing operation being performed with an exemplary vehicle maneuver communication system (VMCS) including an illuminating spotter wand.
Figure 1B:
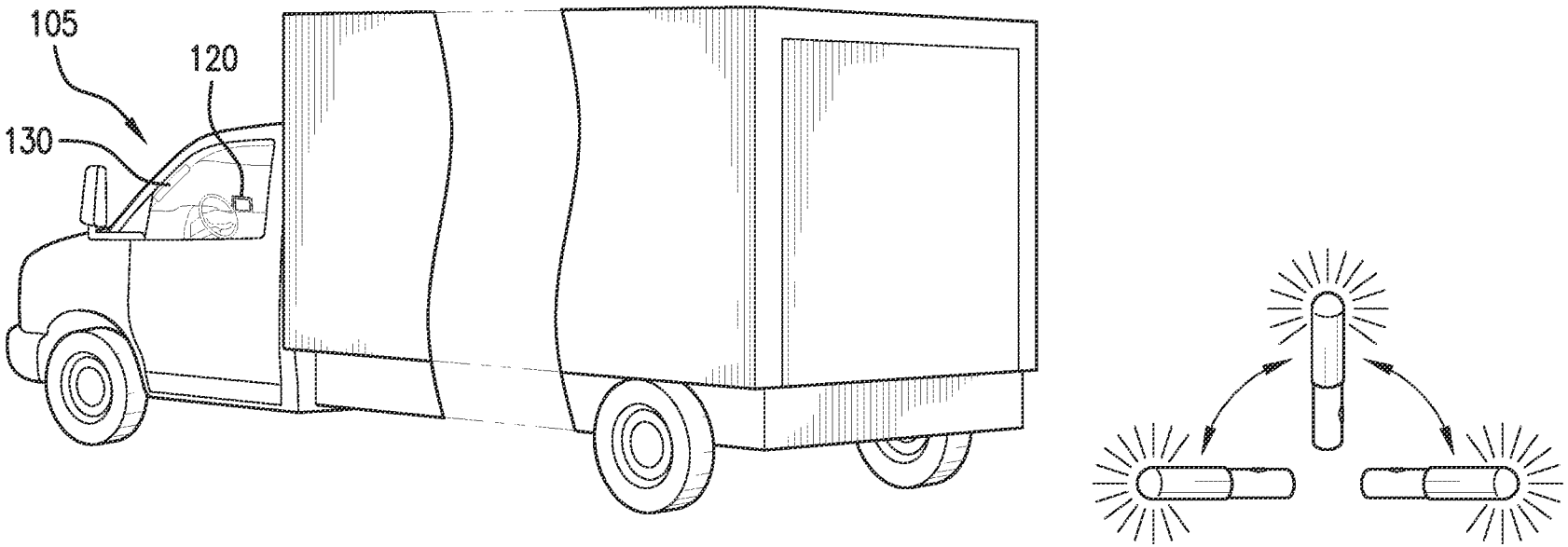

FIGS. 1A-1B show the exemplary VMCS 100 includes a vehicle-mounted sub-system 105 and a handheld spotter module 110 that may communicate safety information from a spotter to the vehicle driver. Advantageously, such direct high visibility signals from a human spotter in the driver's field of view may substantially reduce the likelihood of injury to personnel or damage to property during vehicle maneuvers, such as backing, parking, and re-positioning of a vehicle.

FIG. 1B depicts three exemplary orientations for the HHSM 110: vertical (e.g., substantially perpendicular to the gravity vector), about 90 degrees counter-clockwise with respect to the vertical orientation, and about 90 degrees clockwise with respect to the vertical orientation. The angle with respect to the vertical orientation may be detected by one or more orientation sensors embedded in the HHSM 110 (e.g., acceleration, bubble, or the like). The angle of orientation may be sampled by a processor running in the HHSM 110, and the HHSM 110 may generate an orientation signal. In some embodiments, the orientation signal may be proportional to the angular orientation of the HHSM 110. In some embodiments, the HHSM 110 may transmit a signal indicative of orientation to the CCM 120. In response to this signal, the CCM 120 may cause the signal output module 125 and/or the IMs 130, 135 to indicate a direction and/or magnitude for steering in accordance with the orientation signal.

For example, if the HHSM 110 is oriented counter-clockwise with respect to the vertical, the signal output module 120 may respond by strobing from right to left to indicate a direction for the driver to adjust the maneuvering vehicle. In some embodiments, the IM 130 may flash periodically, and/or the signal output module 125 may flash the left side of the screen. In some examples, the VMSS 105 may display a left arrow, or display a rotation graphic to suggest to the driver to turn the steering wheel in a corresponding counter-clockwise direction, for example.

In some embodiments, the VMSS 105 may further indicate a magnitude of steering adjustment in response to signals that indicate the detected angle of orientation of the HHSM 110. The degree of adjustment in the indicated direction may be communicated via the VMSS 105 by a flash or strobe repetition rate, audible instruction (e.g., "30 degrees"), or length indicated on a visual display within the cab VMSS 105. In various implementations, the driver may visually monitor the angle of the light module 115 to directly determine the spotter's suggested direction and magnitude for steering corrections.

In some embodiments, a tilt or orientation sensor may be employed to convey a suggested speed signal to the driver. By way of example, some embodiments may detect tilt angle with respect to a vertical orientation using orientation sensors configured to detect an angle of a plane that is orthogonal to plane used for the steering orientation. The feedback provided to the driver may include verbal or visual indicia, as described above. Such indicia may include direct visual monitoring of the tilt angle of the HHSM 110, and/or indirect indicia output by the VMSS 105.

In some embodiments, the HHSM 110 may strobe or flash the light module 115 at a variable duty cycle or frequency to directly indicate to the driver a suggested safe magnitude of steering or speed (e.g., or acceleration).

In an exemplary illustrative scenario, a driver may maneuver a fire truck by backing it into a fire station garage, where personnel and property in or around the fire truck's backing path may not be visible to the driver. A spotter assists the driver using the VCMS 100. First, the spotter may obtain the HHSM 110 from the driver. The spotter and driver may discuss a plan for the intended vehicle maneuver. The spotter may get into position to observe the backing path behind the fire truck. Upon determining that the backing path is clear, the spotter may operate a switch on the spotter module, which transitions the VCMS 100 from a stop (e.g., unsafe) mode to a safe mode. In the safe mode, the HHSM 110 illuminates so that it is readily visible to the driver. While the spotter continues to engage the switch, the HHSM 110 and the VMSS 105 illuminate (e.g., with a greenish color) to indicate to the driver that it is safe to back up.

In various implementations, the HHSM 110 may communicate multi-mode safety information from a spotter to the vehicle driver and/or to the VMSS 105 to substantially reduce the likelihood of injury to personnel or damage to property. In some examples, multi-mode safety information may involve direct visual signals, alone or in combination with indirect audio/visual indicia generated in response to electronically-encoded and transmitted signals.

The depicted VMSS 105 includes a cab control module (CCM) 120, a signal output module 125, and indicator modules (IM) 130, 135. The depicted CCM 120 has a housing disposed on a dashboard of the vehicle. The CCM 120 is in wireless communication with the spotter module 110 via a wireless link (not shown). The CCM 120 controls whether the VMSS 105 is in the safe mode or the stop mode in response to a most recent safety state information received from the switch on the HHSM 110. Safety state information in the HHSM 110 may be transmitted for display or other indication by the signal output module 125, and/or the IM 130, 135.

In the event of a communication link fault (e.g., loss of maintenance signal), various embodiments of the CCM 120 may transition automatically to the unsafe state. For example, if a watchdog timer times out in the absence of a required signal from the HHMS 110, then the state of the VMSS 105 may transition to the unsafe state.

The signal output module 125 provides indications to the driver based on whether the CCM 120 is in the safe mode or the stop mode. In the depicted example, the signal output module 125 includes visible displays on the housing of the CCM 120, which may be coordinated with indicator modules (IM) 130, 135 mounted on A-posts on the driver and passenger sides, respectively. In the depicted figure, the IM 130, 135 are individually within the driver's field of view when the driver looks at the rear view mirror on the driver's and passenger's side doors, respectively.

In some embodiments, the HHSM 110 may transition to an active state mode in response to a signal that indicates that the driver has engaged a backing gear of the vehicle. Upon transition to active state, some embodiments may illuminate the HHSM 110 and/or the indicators in the VMSS 105 with a first illumination pattern that indicates to the driver to stop the vehicle. By way of example and not limitation, the first illumination pattern may include a predominately orange or reddish color. In some examples, the first illumination may flash a color in a predetermined pattern to provide visible indication that the vehicle should be stopped.

The IMs 130, 135 may include one or more illumination elements or two or more colors (e.g., red, green). Example embodiments of the IMs 130, 135 are described in further detail with reference to FIGS. 3A-3B.

In some implementations, the signal output module 125 may incorporate signaling modes in addition to or instead of the illuminated display of the side light indicators 130, 135. For example, the signal output module 125 may incorporate a display of photographs or video information from at least one camera. The camera information may show a region around the vehicle that is near the path of travel of the vehicle. The camera may display visible and/or infrared images of the viewed area. The signal output module 125 may further include, alone or in combination with the camera information, certain audible information. For example, the signal output module 125 may include a one-way or duplex radio link for voice channel information conveyed over a data communication channel linking the HHSM 110 to the CCM 120.

In various examples, the signal output module 125 in coordination with the IMs 130, 135 may emit one more audible sounds and/or visual color indications (e.g., red or green) at locations generally in front of and to the each side of the driver. As the driver looks left, right, or to the front of the vehicle, at least one of the visual color indications may be within the driver's field of view. In some examples, the signal output module 125 may control one or more visual display elements that may be mounted on or around an exterior mirror on either side of the vehicle. In some examples, the signal output module 125 may control one or more visual display elements coupled to the front windshield that may be, for example, releasably attached to an interior surface of the front windshield using suction cups. Some examples may include a light elements disposed on or around a central rear view mirror to facilitate the driver's detection of safety condition signals while looking generally forward and/or to the left or right. In some examples, one or more visible and/or audible indicator elements may be disposed on or around the dashboard within sight or perception range of the driver.

FIGS. 2-4B show front, back, and side perspective views of exemplary components for the VMCS of FIG. 1A.

Figure 2:
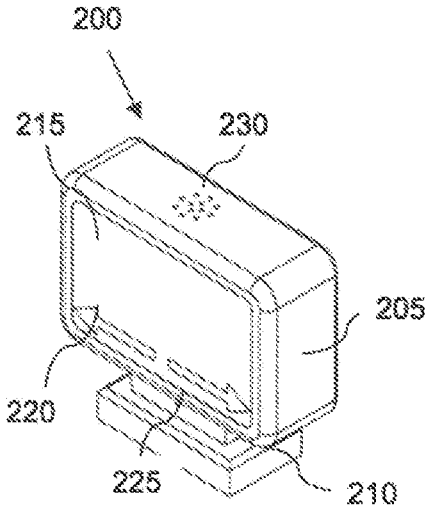
FIGS. 2-4B show front, back, and side perspective views of exemplary components for the VMCS of FIG. 1A.

FIG. 2 shows a perspective view of an exemplary cab control module 200, which could be implemented as the CCM 120 of FIG. 1A. The cab control module 200 includes a housing 205 and a dashboard base 210 for mounting the cab control module 200 onto the dashboard in the cab of a vehicle. The housing 205 includes a visual display device, which includes a screen 215, direction indicators 220 and 225, and an audio interface 230. The cab control module may includes at least a processor for controlling operations, a wireless communication interface, and a data store for recording events involving the use of the VMCS.

In some implementations, the CCM 200 may transition to an active state (system activation mode, safe mode, warning mode) or an inactive state (e.g., low power or sleep mode, system off mode). In the active state, the CCM 200 may initiate a wake-up signal to cause the spotter module to transitions from an inactive state to an active state. In an illustrative example, the cab control module 200 may be configured to automatically detect when the vehicle is in a backing gear. The CCM 200 may include a backing detection module, which may be wired, for example, to monitor a vehicle's transmission or transmission control systems, and configured to generate a signal to the CCM 200 to include that the vehicle is configured to perform a backing maneuver. In some implementations, the CCM 200 may detect reverse rotation of a wheel of the vehicle. In some implementations, the CCM 200 may be configured to enter the active mode in response to the backing detection module and/or the reverse rotation detection. Various examples may transition the CCM 200 back to an inactive mode upon the vehicle shifting out of a backing gear (e.g., to a neutral or forward gear) or upon a predetermined forward rotation of the vehicle's wheel.

In illustrative example, the cab control module 200 controls the vehicle-mounted subsystem to indicate the various system states. The different states may be based on the state of the vehicle (e.g., vehicle in park or reverse) or communications by the handheld spotter module. The CCM 200 is in wireless communication with a spotter module via a wireless link (not depicted).

The screen 215 may illuminate and a speaker in the audio communication interface 239 may sound an audible tone based on the various modes of the system. In an illustrative example, the screen 215 does not illuminate when in the sleep mode (e.g., vehicle in park), does illuminate (e.g., reddish color) when in system activation mode (e.g., vehicle shifted in reverse) or when in warning mode (e.g., spotter signals the spotter module to communicate that it is not safe to back up the vehicle), or illuminate (e.g., greenish color) when in safe mode (e.g., spotter signals the spotter module to communicate that the driver can back up safely). In various implementations, the speaker may sound an audible tone when the system is in system activation mode or warning mode.

The direction indicator 220 may guide a driver to the left or right based on communications by a spotter operating a HHSM 110. In some implementations, rotation of the spotter module to the left may illuminate the left arrow of the direction indicator 220 and rotation of the spotter module to the right may illuminate the right arrow of the direction indicator 225. A driver may communicate with a spotter via a microphone in the audio communication interface 230.

The signal output module 125 (FIG. 1A) may provide indications to the driver based on whether the CCM 200 is in the safe mode or the stop mode. In some implementations, the signal output module 125 may include one or more side light indicators 130, 135 in addition to the display on the CCM.

Figure 3A:
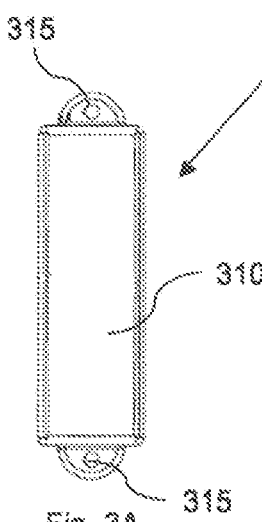
Figure 3B:
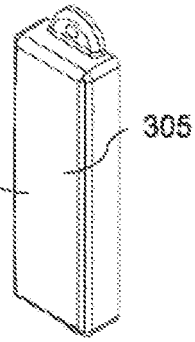

FIGS. 3A and 3B show front and perspective views of an exemplary side light indicator module 300, which could be used as the IM 130, 135 of FIG. 1A. The light indicator module 300 includes a housing 305 with a side light indicator illumination element 310, and a pair of mounting holes 315 at opposing ends of the side light indicator. As discussed above, the side light indicator may be a driver's side light indicator on the A-post or A-pillar on the driver side of the vehicle or a passenger's side light indicator on the A-post or A-pillar on the passenger side of the vehicle. In various implementations, a driver's side light indicator may be on the driver's side rear view mirror and a passenger's side light indicator may be on the passenger's side rear view mirror.

As part of the vehicle-mounted sub-system (VMSS), the side light indicator module 300 is also controlled by the cab control module 200 to indicate the various modes of the system that correspond to the state of the vehicle (e.g., in park or reverse) or communications by a spotter on the spotter module. The screen 310 may illuminate red or green or may not illuminate at all. In some implementations, the side light indicator illumination element 310 does not illuminate when in the sleep mode (e.g., vehicle in park), illuminates red when in system activation mode (e.g., vehicle shifted in reverse) or when in warning mode (e.g., spotter signals the spotter module to communicate that it is not safe to back up the vehicle), or illuminates green when in safe mode (e.g., spotter signals the spotter module to communicate that the driver can back up safely).

Figure 4A:
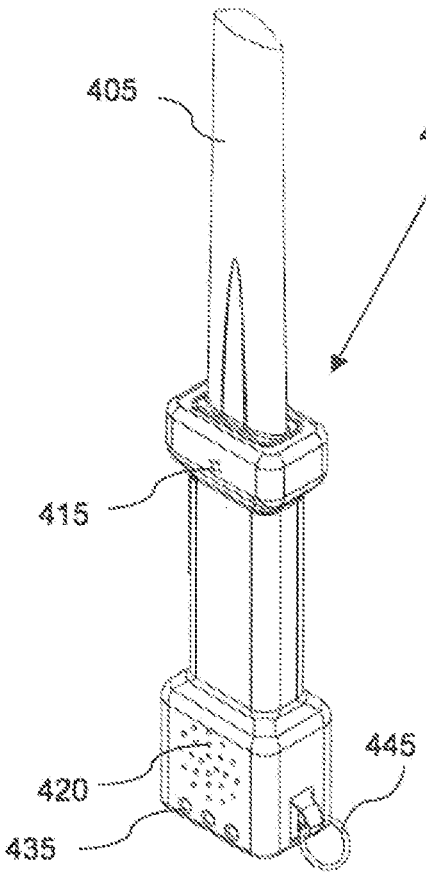
Figure 4B:
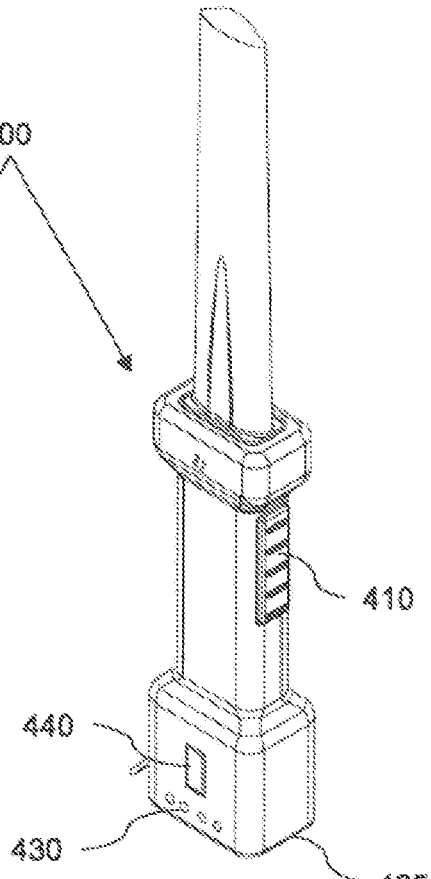

FIGS. 4A and 4B show front and back perspective views of an exemplary handheld spotter module 400. The handheld spotter module (HHSM) 400 includes a light module 405, safety state control switch (SSCS) 410, microphone 415, speaker 420, battery 425, battery charger contacts 430, battery life indicators 435, battery release button 440, and gripping element 445. The HHSM 400 may be programmed with a unique identifier code. In the presence of more than one vehicle with a VMCS, the unique code provides a mechanism for communicating exclusively with a specific vehicle within a fleet that has the CCM 120 associated with the unique identifier code.

In some embodiments, the HHSM 110 transitions to an active state mode in response to a signal from the CCM 120 that indicates that the driver has engaged a backing gear of the vehicle. Upon transition to the active state, some embodiments may illuminate the HHSM 110 with a first illumination pattern that indicates to the driver to stop the vehicle. By way of example and not limitation, the first illumination may be a reddish color. In some examples, the first illumination may flash a color in a predetermined dynamic pattern to provide visible indication that the vehicle should be stopped.

In an illustrative example, the spotter illumination element may illuminate based on the state of the vehicle (e.g., in park or reverse) or signals provided by a spotter using the HHSM 400 (e.g., release or press of switch 410 or rotation of the spotter module 400). In some implementations, the handheld spotter module 400 does not illuminate when in the sleep mode (e.g., vehicle in park). In various implementations, the handheld spotter module illuminates a pattern of reddish color twice and then remains steady when in system activation mode (e.g., vehicle shifted in reverse). In various implementations, the HHSM 400 illuminates a steady reddish pattern when in warning mode (e.g., spotter signals the spotter module to communicate that it is not safe to back up the vehicle). In some implementations, the light module 405 illuminates green when in safe mode (e.g., spotter signals the spotter module to communicate that the driver can back up safely).

Figure 5:
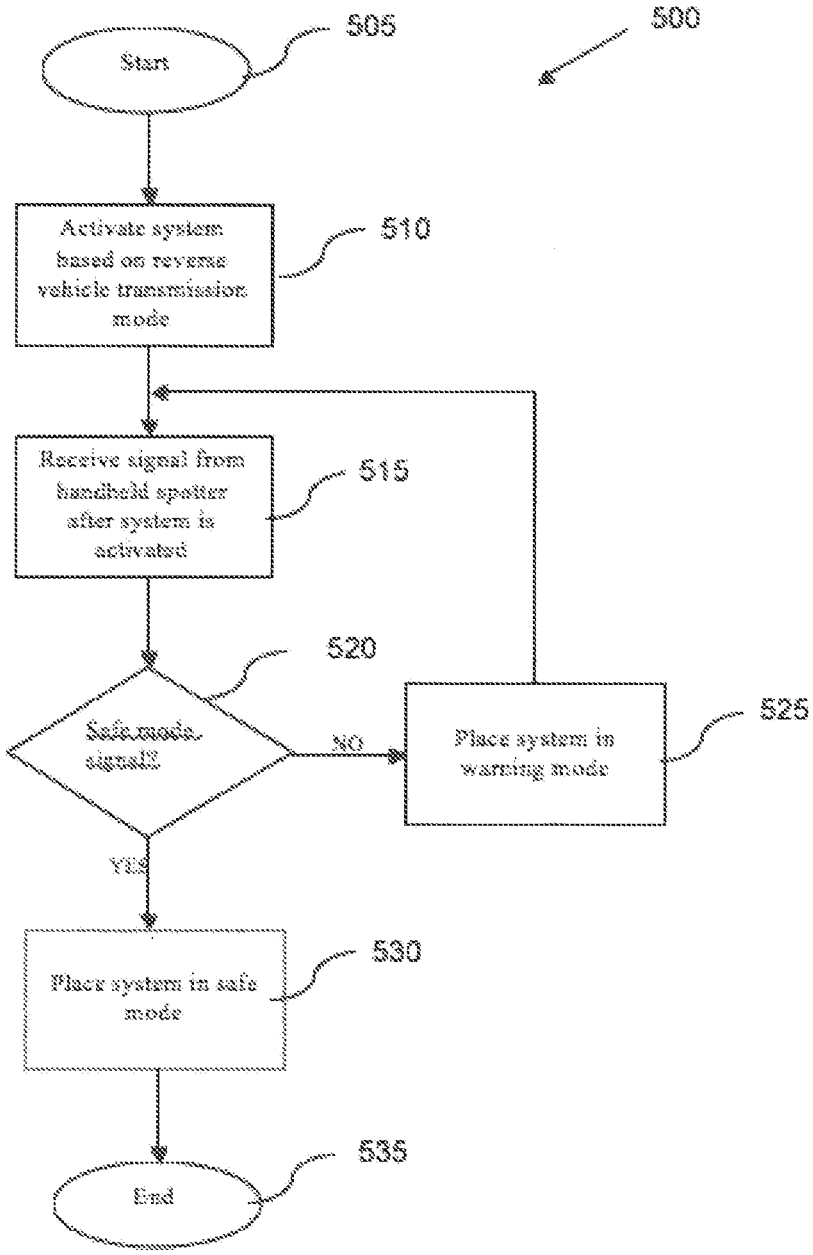
FIG. 5 shows an exemplary set of steps for operating a cab control module in the VMCS of FIG. 1A.

FIG. 5 shows an exemplary set of steps for operating a cab control module in the VMCS of FIG. 1A. For example, a method 500 can be performed by the CCM 200 as described with reference to FIG. 2. In an illustrative scenario, a driver may maneuver a fire truck by backing it into a fire station garage, in which personnel and property in or around the fire truck's backing path may not be visible to the driver. A spotter assists the driver using the VCMS 100. First, the spotter obtains the spotter module 110 from the driver. The spotter and driver may discuss a plan for the intended vehicle maneuver. The spotter gets into position to observe the backing path behind the fire truck.

The method 500 may begin in step 505 when the VMCS 100 comes out of the inactive state or sleep mode. Generally, the VMCS 100 may be in the inactive state or sleep mode when the vehicle is in park. In step 510 of this example, the VMCS 100 is configured to automatically activate when the vehicle is shifted into reverse. In the system activation mode, the CCM 120 may emit an audible tone and ensure that components of the signal output module 125, such as the light indicator on the cab CMM 120 display and any side light indicator modules 300, illuminate, for example, a reddish color consistent with an indication of a non-safe state.

Upon determining that the backing path is clear, the spotter would actuate the SSCS on the HHSM 110. Absent any fault conditions, the HHSM 110 may transmit a signal indication that the VCMS 100 is authorized to transition from a stop mode to a safe mode. In step 515, the CCM 120 receives the signal originated from the HHSM 110. In step 520, the CCM 120 determines whether the received signal corresponds to the safe mode or to the unsafe mode (also referred to herein as "warning mode").

If the received signal does not indicate safe mode, then, at step 525, the CCM 120 may place the VMCS 100 into warning mode. The CCM 120 and the IM 130, 135 may illuminate and/or indicate according to the non-safe state (e.g., red with an audible alarm tone), and then repeats step 515.

However, if at step 520 the received signal does indicate safe mode, then, at step 530, the CCM 120 may place the VMCS 100 into safe mode. In the safe mode, the HHSM 110 illuminates according to the safe state (e.g., green, blue, or combination thereof) so that it is readily visible to the driver. While the spotter continues to engage the switch, the spotter module and the VMSS 105 illuminate (e.g., with a greenish color) and the audible tone is silenced to indicate to the driver that it is safe to back up.

At step 535, the method ends, for example, when CCM 120 detects that the driver has placed the vehicle transmission into park.

Figure 6:
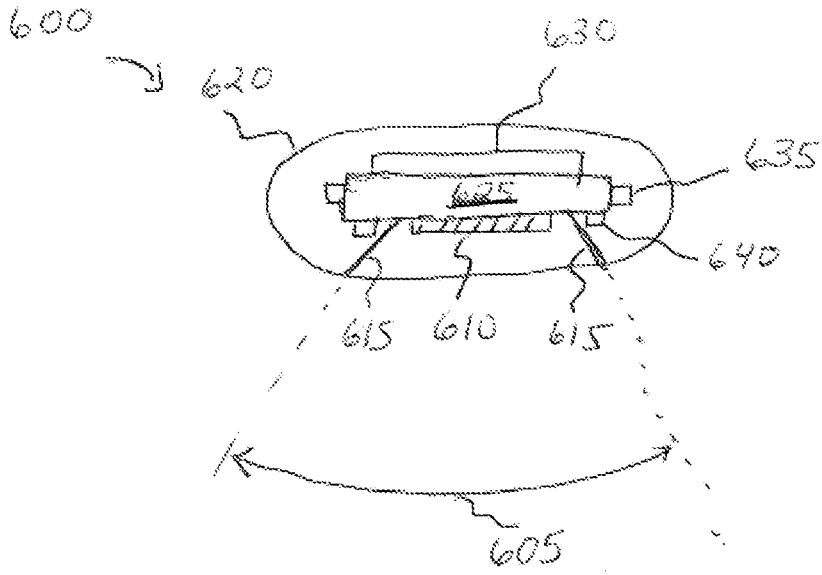
FIGS. 6-7 show top and side perspective views of exemplary embodiments of a handheld spotter module (HHSM) for use in the VMCS of FIG. 1A.
Figure 7:
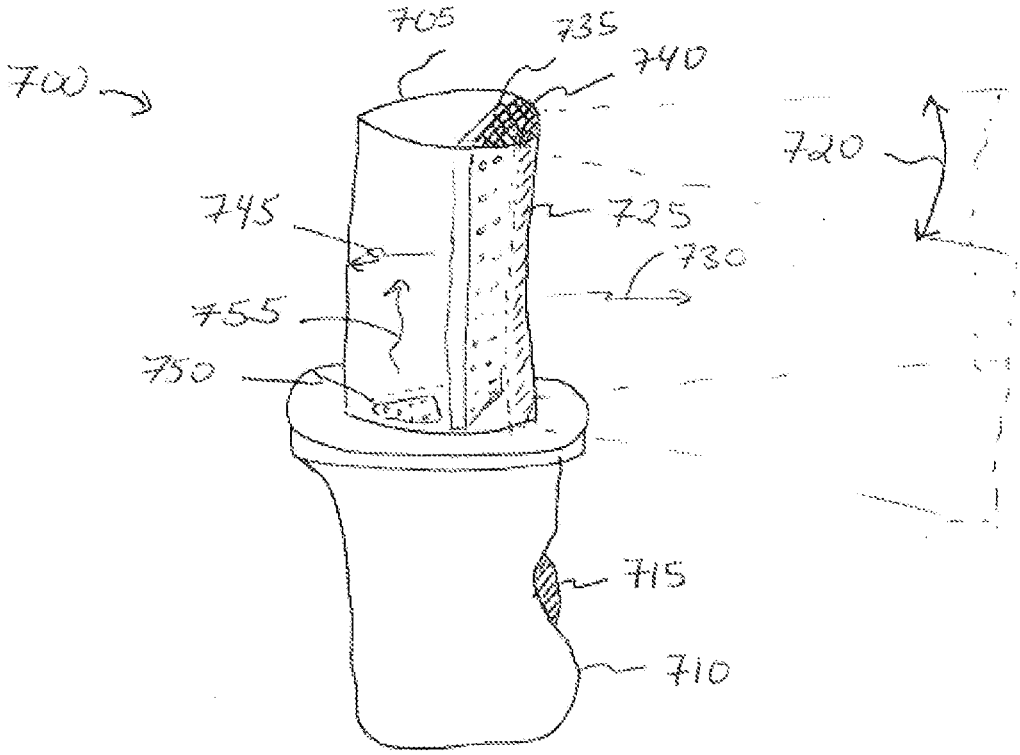

FIGS. 6-7 show top and side perspective views of exemplary embodiments of a handheld spotter module (HHSM) for use in the VMCS of FIG. 1A. FIG. 6 depicts an exemplary HHSM 600 configured to project a safety signal to the driver within a beam angle 605. The beam angle 605 may be formed by light emitted from illuminant 610 and shaped into a beam by reflectors 615. In operation, the safety signal would be visible within the beam angle, but visibility of the signal would be substantially attenuated outside of the beam angle 605. Advantageously, the limited beam angle 605 may permit selective communication from the spotter to the driver that substantially excludes viewing from positions not within the beam. Such angular selective illumination may promote safety, for example, by reducing the opportunity for communicating to vehicle drivers who are not the intended recipients of the signal from interpreting a safe signal intended for one vehicle as an indication that a different vehicle is clear to advance.

In the depicted embodiment, the HHSM 600 is further arranged to provide auxiliary illumination for directions outside of the beam angle 605. The HHSM 600 includes a translucent lens 620 forming a light chamber that encompasses a substrate 625 that extends axially within the light module and provide mechanical support and electrical connection to illuminants 630, 635, and 640, which are depicted as providing light output in directions outside of the beam angle 605. The lens 620 may in some embodiments provide some diffusion to blur the outlines of individual illuminant elements.

In various examples, the illuminants 610, 630, 635, 640 may be formed from one or more types of light sources. In some examples, the illuminants may include light emitting diodes (LEDs), which may include high brightness LEDs. Some illuminants suitable for use alone or in combination with other illuminants may include, but are not limited to, incandescent and xenon flash devices. Various devices may be distributed over a region of the substrate 625, alone or with optical elements, to create a high visibility illuminating wand to promote visibility. The illuminants may include discrete or separately controlled groups of illuminants to permit strobing or to give the appearance of motion or graphic effects. In some examples, illuminants with various colors may be arranged in arrays that are separately controllable to provide for distinctive colors according to operating states (e.g., green in safe mode, reddish in unsafe mode).

FIG. 7 depicts an exemplary HHSM 700 configured to project a safety signal to the driver within a beam angle using an optical lens to shape the beam. The HHSM 700 includes a light module 705 coupled to a grip 710, which includes a safety state control switch (SSCS) 715. The light module 705 forms a primary communication beam to be directed to the driver within a primary beam angle 720. The primary beam angle 720 is substantially centered in a vertical plane that intersects the SSCS 715, which may advantageously allow the spotter to substantially naturally and accurately aim the beam angle 720 by pointing the SSCS 715 along a vector directed toward the driver. The primary beam angle 720 may, as depicted in this example, be formed by a beam shaping lens 725 formed into a leading edge of a lens for the light module 705. The lens 725 may include a material with an index of refraction and shape and thickness to form a desired beam pattern. For example, the lens may substantially form a collimating lens that may be advantageous for applications with a variable distance between the spotter and the driver. In some applications in which the distance from the spotter to the driver is substantially consistent, the beam shaping lens 725 may include a focusing lens with a focal length set to optimize visibility to the driver over a wider angular range of alignment of the beam angle to vector between the spotter and the driver.

In the depicted example, the HHSM 700 emits a primary signal flux 730 within the primary beam angle 720. The primary signal flux 730 is formed by light emitted from an illuminants arranged on a substrate 735 that extends axially within the light module 705. The HHSM 700 includes a translucent lens forming a light chamber defined by a reflector 740 that, in this example, reflects the primary signal flux 730 from emitting in an axial direction without a substantially radial component. In some applications, this may advantageously reduce likelihood of confusion due to safety state signal in the primary signal flux 730 from being viewed by an unintended vehicle driver.

The substrate 735 provides mechanical support and electrical connections to illuminants that emit a radial auxiliary flux 745 in a direction generally opposite to the direction of the primary signal safety flux 730. An axial auxiliary flux source 750 is arranged to emit an axial auxiliary flux 755 along an axis of the light module 705. The fluxes 745, 755 may be configured to reduce likelihood of confusion of unintended vehicle drivers by providing a substantially different illumination (e.g., red) than that of the primary signal flux 730 when in the safe mode (e.g., green or blue). In an illustrative example, the radial auxiliary flux 745 may include a substantial red component visible outside of the primary beam angle 720, and the axial auxiliary flux 755 may include a white component, for example, to provide the spotter with a spot flashlight functionality, for example. The auxiliary fluxes 745, 755 may be controlled independent of the SSCS 715, in some examples.

Figure 8:
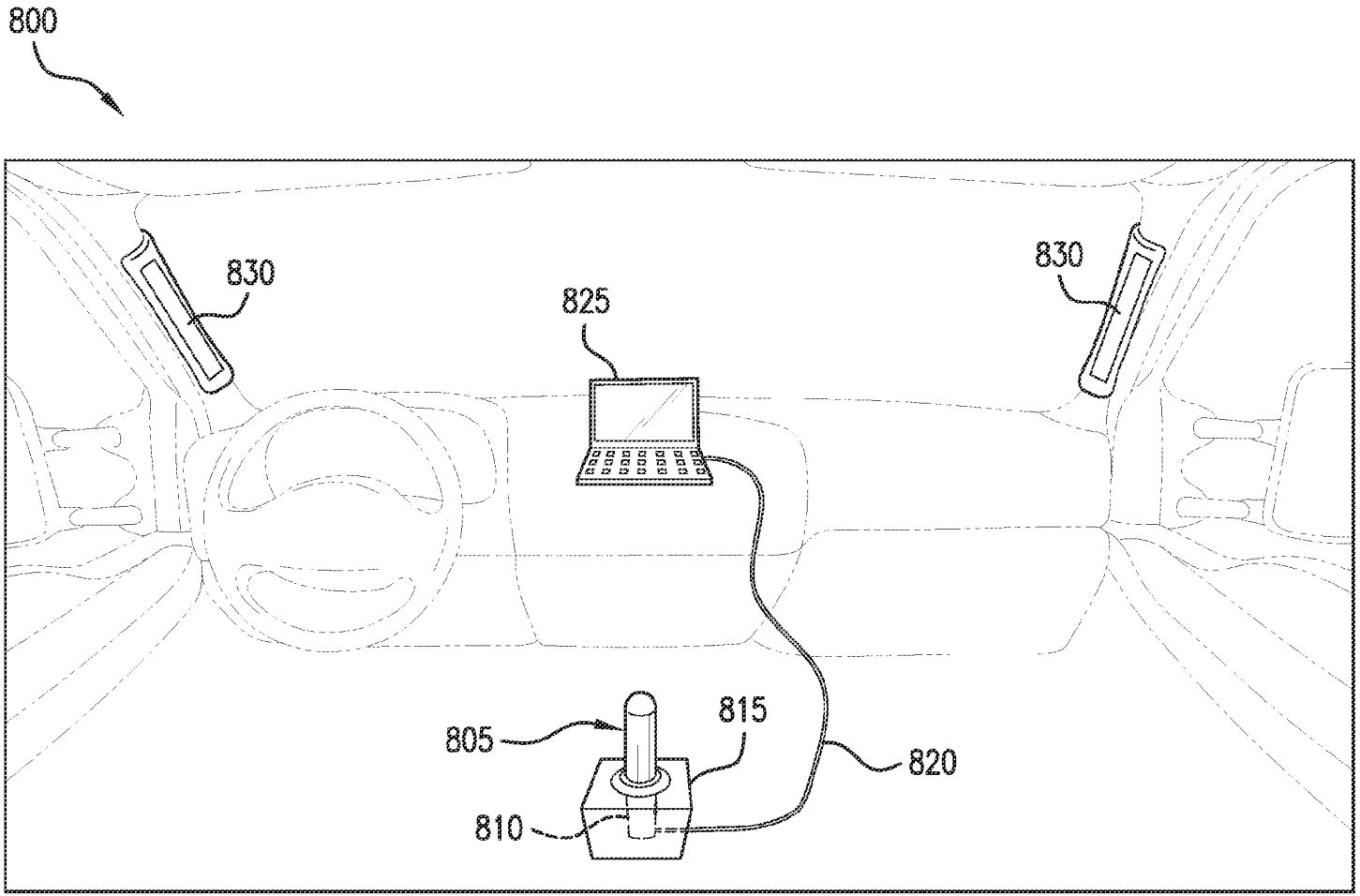
FIG. 8 shows a partial perspective view of a vehicle cab equipped with an exemplary VMCS.

FIG. 8 shows a partial perspective view of a vehicle cab equipped with an exemplary VMCS. In this example, the cab includes a VMSS 800 configured with a HHSM 805, which includes a grip 810 removably stored in a storage module 815. The storage module 815 in this example provides a secure location for the HHSM 805 when not in use, but it is conveniently accessible by the driver to pass to a spotter prior to a vehicle maneuver. The storage module may provide a pocket to receive the HHSM 805 and, for example, an adhesive-back plate for mounting to a convenient surface in the cab.

The VMSS 800 further includes a cable 820 and a portable computer 825 coupled to the HHSM 805 through the cable 820. In an illustrative example, the cable 820 may be a USB cable (universal serial bus) that conveys power to charge a battery in the HHSM 805, and further provides a serial interconnection for transferring programming and data information between the portable computer 825 and the HHSM 805 data processing and storage circuitry. In an example, the HHSM 805 may receive instructions, identification information via the cable 820, while recharging the battery. In a further example, the HHSM 805 may transfer log files, health, synchronization, and other information to the portable computer 825 via the cable 820. In various examples, the cable 820 may be a custom, parallel, serial, or other suitable cable that provides power and/or data paths for operating and maintaining the HHSM 805.

The VMSS 800 further includes indicator modules (IM) 830 mounted on the A-posts to provide visible indicia of system safety states whenever the driver's field of view is toward the left or right sides of the cab. In some implementations, the indicator modules may be mounted on the exterior mirror frame instead of the interior A-post. The IM 830 may be battery powered or receive a wired power connection to a vehicle mounted power source (e.g., battery, solar panel). The IM 830 may be in data communication with the computer 825 via a wired, wireless communication link in a master-slave relationship. In various examples, the wireless link may include communication via RF (e.g., Bluetooth, zigbee, or the like), audio responsive sound outputs of the portable computer 825, or optical link (e.g., infrared).

Figure 9:
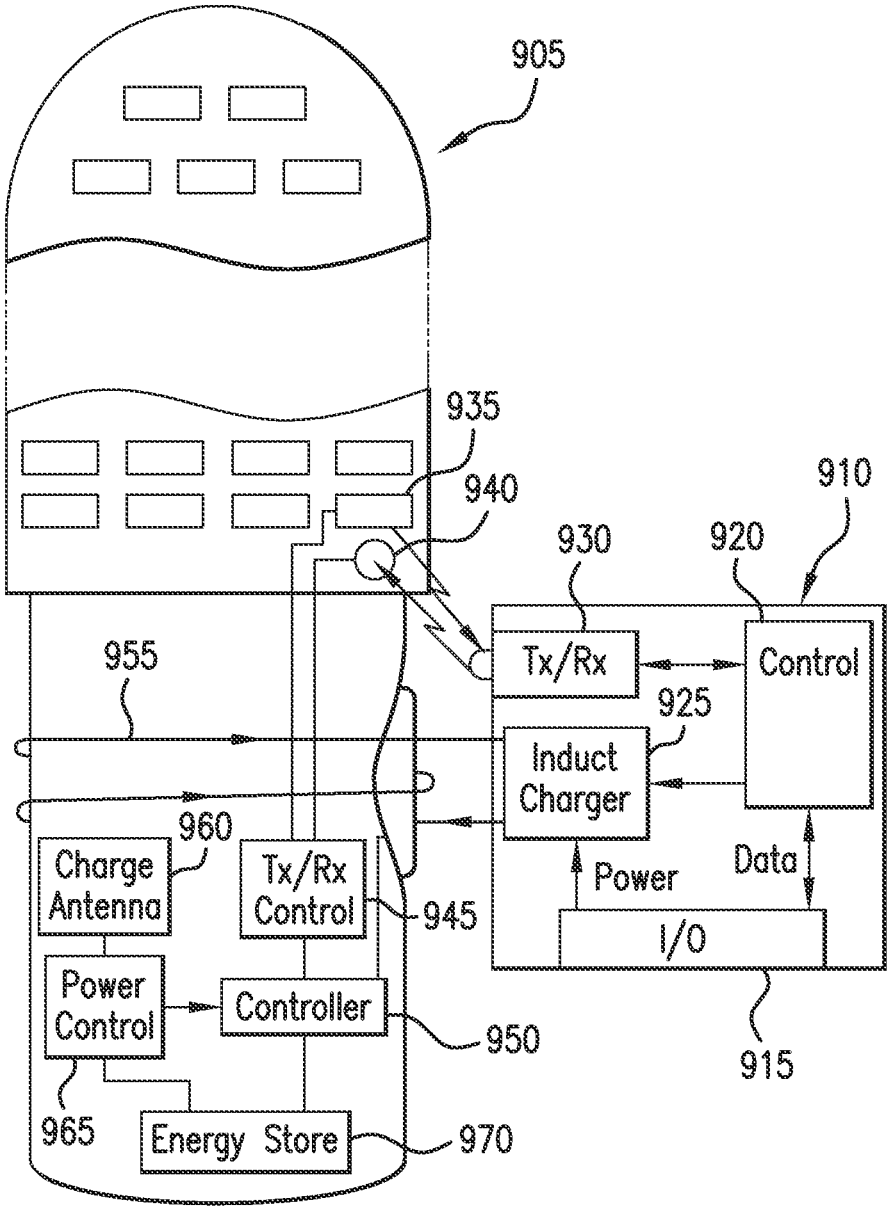
FIG. 9 shows a block diagram representation of an exemplary HHSM with a wireless power and data interface module.

FIG. 9 shows a block diagram representation of an exemplary HHSM with a wireless power and data interface module. Contactless power and data communication may permit the HMSS to be substantially sealed against the ingress of water or dust, and at relatively low cost. In the depicted figure, a HHSM 905 with an array of illuminants (e.g., LEDs) is wirelessly coupled to receive power and exchange data with an interface module 910. The interface module 910 may be stored, for example, wherever programming, data downloads, and/or battery charging is needed for the HHSM 905. In some applications, the interface module may be mounted in the cab of a vehicle as part of the VMSS. In some other applications, the interface module may be located at a fleet vehicle facility, such as a warehouse or airport terminal, an example of which will be described with reference to FIG. 10.

In the depicted example, the interface module 910 includes an input/output port 915 for communicating data signals to and from a controller 920, and power signals to an inductive charger 925. Data signals may be processed for bidirectional data flows to a transceiver 930 in optical communication with a transmitter 935 and a receiver 940 (e.g., phototransistor) in communication with a transceiver controller 945 on the HHSM 905. In one example, the light module of the HHSM 905 provides control of one LED to transmit data, which LED may also serve as an illuminating LED during operation of the VMCS 100, for example.

The HHSM 905 further includes a controller 950 coupled to control the operation of the transceiver controller 945 in accordance with a program of instructions, including communication protocol code, which may be stored in a data store (not shown). The data communication may receive and transmit information, such as log files and security codes, which may be stored as data in an internal data store accessible by the controller 950.

Power signals may be delivered from the inductive charger 925 via a charge coil 955, which may be arranged to generate a time-varying magnetic field that couples to a charging antenna 960 in the HHSM 905. Power coupled to the antenna 960 may be processed by a power controller 965, which may further transfer the energy for storage to an energy store module 970 (e.g., battery, capacitor).

Figure 10:
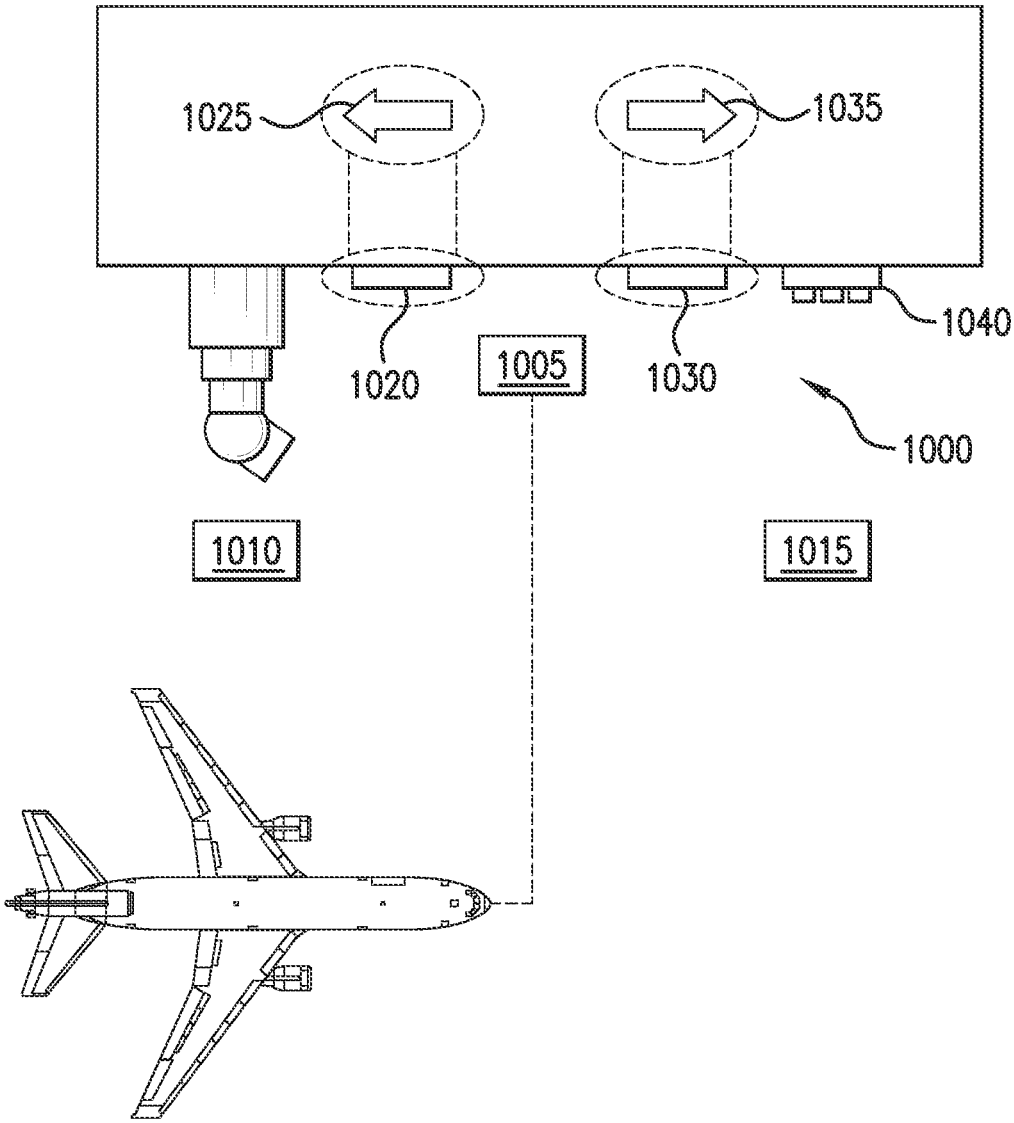
FIG. 10 shows a top view of an exemplary VMCS for communicating safety information during maneuvers of an aircraft around a terminal.

FIG. 10 shows a top view of an exemplary VMCS for communicating safety information during maneuvers of an aircraft around a terminal. In the depicted exemplary VMCS 1000, an aircraft (e.g., commercial airplane, helicopter, or the like) may receive safety information from a nose and two wing spotters, each operating with at least one HHSM 1005, 1010, 1015 while maneuvering near a terminal of an airport. The VMCS 1000 can increase safety by providing a high visibility indicator 1020 (shown in a side view detail as indicator 1025) and a high visibility indicator 1030 (shown in a side view detail as indicator 1035). The indicators 1020, 1030 may be illuminated with a red color to indicate that the aircraft maneuver should stop, and in a green color to indicate that the aircraft is safe to maneuver. The indicators 1020, 1030 are large and bright enough, and located on the exterior wall of the terminal building to permit ready visibility by a pilot in the cockpit of even a large aircraft.

In the depicted example, there are two indicators 1020, 1030, arranged as left and right arrow symbols. In accordance with the orientation sensor functionality described with reference to FIG. 1B, the spotters can communicate directional information for accurate steering and stopping points by orientation angle of the HHSM 1005, alone or in combination with the HHSM 1010, 1015.

In some embodiments, the VMCS 1000 may include an interlock that will maintain the indicators 1020, 1030 in an unsafe (e.g., red) state unless the jet way is retracted to a safe distance from the aircraft operating area.

In an exemplary operation, a ground crew may prepare for the arrival or departure of an aircraft by retrieving HHSM 1005, 1010, 1015 from an HHSM storage system 1040. The storage system 1040 may include a number of charging stations and data interface capabilities, examples of which are described with reference to FIGS. 8-9, for example. The ground crew can operate the HHSM 1005, 1010, 1015 by actuating each SSCS. The indicators 1020, 1030 will respond to the safety information delivered from each of the HHSM 1005, 1010, and 1015 by transitioning to the safe (e.g., green)

state only of all of HHSM 1005, 1010, and 1015 are in safe mode (e.g., the ground crew are each actuating the SSCS on their respective handheld spotter modules).

Although various embodiments have been described with reference to the figures, other embodiments are possible. For example, some bypass circuit implementations may be controlled in response to signals from analog or digital components, which may be discrete, integrated, or a combination of each. Some embodiments may include programmed and/or programmable devices (e.g., PLAs, PLDs, ASICs, microcontroller, microprocessor, digital signal processor (DSP)), and may include one or more data stores (e.g., cell, register, block, page) that provide single or multi-level digital data storage capability, and which may be volatile and/or non-volatile. Some control functions may be implemented in hardware, software, firmware, or a combination of any of them.

Computer program products may contain a set of instructions that, when executed by a processor device, cause the processor to perform prescribed functions. These functions may be performed in conjunction with controlled devices in operable communication with the processor. Computer program products, which may include software, may be stored in a data store tangibly embedded on a storage medium, such as an electronic, magnetic, or rotating storage device, and may be fixed or removable (e.g., hard disk, floppy disk, thumb drive, CD, DVD).

In some embodiments, a strobed light may flash in response to a state of the VCMS 100. The strobed light may be generated, for example, by a flash tube or high visibility LED lamp. In an illustrative example, the spotter module 110 may illuminate as red band with a white or bluish-white flashing strobe when in a stop mode. The flashing may be, for example, about 5 Hz, 4 Hz, 3 Hz, 2 Hz, 1 Hz, 0.8 Hz, or about 0.5 Hz. In a safe mode, the spotter module 105 may illuminate as a green band with a steady white supplemental light. In some examples, further differentiation may be made visible to the driver by modulating the supplemental light intensity based on the current mode. For example, the supplemental light may be at a high intensity when the VCMS 100 is in a stop mode, but at a substantially lower intensity when the VCMS 100 is in a safe mode.

In some implementations that detect orientation of the spotter module 110, a supplemental light may illuminate at a single point on the spotter module, such as at the distal end of the module 110. When a tilt mode is detected, the supplemental light may illuminate, for example, with a strobe frequency that is substantially less than the strobe frequency when in stop mode. By way of example, a strobe frequency during a directional tilt signal may be about 1 Hz, 0.75 Hz, 0.5 Hz, 0.4 Hz, or about 0.3 Hz. In some implementations, the supplemental illumination during tilt operation may include sequential illumination in a ripple effect from the proximal to the distal end along the length of the spotter module.

In an exemplary embodiment, a VMCS may in some cases be programmed to receive information on predetermined frequencies using wireless protocols (e.g., zigbee, Bluetooth, Wi-Fi). By way of example and not limitation, the received information may include global positioning information for the destination (e.g., at a construction site, or selected bay of a shipping center), coding information to facilitate operation (e.g., wireless communication protocols and frequency) of a local handheld wand with the VMCS on the vehicle, or local camera photographic or video image information representing the region in which the vehicle may be backing. In some examples, information may be updated in real time for display to the driver.

In accordance with another embodiment, the visual display channel may include at least one photographic or video image of a region behind the vehicle. For example, some implementations may include one or more cameras directed to image the region behind the vehicle. In various examples, one or more cameras may be mounted on the vehicle so that each camera can image a field of view to detect objects that may be approaching or within the backing path of the vehicle.

In some implementations, one or more site cameras may be provided at the site with a field of view that includes at least a portion of the vehicle's backing path. For example, a shipping center with one or more vehicle docking bays may have one or more stationary cameras with a field of view that includes the vehicle backing path. For example, one or more overhead cameras located above the backing site may have a view of the left or right of the vehicle backing path to provide a view of the clearance between the backing vehicle and objects to its left or right, respectively. In some examples, a camera mounted in or near the floor may image objects around the end of travel.

In some examples, camera image information may be transmitted to the VMCS controller via wired and/or optical data paths from vehicle-mounted cameras. Image information from site and/or vehicle mounted cameras may be transmitted to the CCM via a wireless (e.g., radio) link to a receiving antenna coupled to the CCM.

In some examples, video image information may be displayed to the driver and may advantageously supplement the safety information communicated by the spotter(s) using handheld spotting wands. In some examples, image processing software may operate to automatically detect stationary or moving objects in the path of the backing vehicle. If an object is detected by the image processor to be approaching or within a predetermined region near the back of the vehicle, then the VMCS may enter the unsafe mode.

The VMCS may be used with a variety of different vehicles. The control module may be mounted outside of the plane against an airport structure, such as airport gate or terminal building. The pilot in the airplane may view the light signals from the signal output module from within the plane. The spotters on the tarmac may have multiple wands, each of which could learn their associated gate number and synch through a charging station at the gate. The control module on the terminal building may provide the signal. When the terminal is unattended, the terminal light on the control module and any side indicators remains red. When a wand is removed from the charger, the wand illuminates red. When all spotters are in position with red wands, they must all depress their wand triggers in order for their wands and the terminal lights to turn green to communicate to the pilot that it is safe for the plane to approach the gate. All the wands may be in communication with a master control module and each other, either directly or indirectly through a master control module. If one spotter gives a red signal, all the spotters' wands change to red and the terminal lights go red. The spotter at the nose of the aircraft usually signals the plane to turn left or right and stop or go. The tilt activation could be activated in this wand only and there could be lighted directional arrows on the cab control module on the terminal along with the stop and go lights. If the spotter tips the wand, the pilot would see a directional signal on the terminal. The signals could also be sent to a system directly in the cockpit or to the pilot's headset as well. For signaling helicopters at a helipad, the spotter could use the wand the same as in the airport gate except the gate lights would be located in or on the ground, on the ship or on the building if it is a rooftop pad. The spotter could give the same signals and safely guide the aircraft or give a red abort signal if needed.

To advantageously distinguish the illumination from the VMCS equipment from illumination produced by common non-VMCS equipment, the safe state color may, in some examples, be selected to include a substantially different spectral content than non-VMCS equipment (e.g., white flash lights). Although reference is made herein in examples that the unsafe state color may be red and safe state color may be green or blue; however, any colors or combination of colors (e.g., multi-color stripes or concentric rings), graphic symbols or letters (e.g., X) formed by illuminating elements, such as LEDs, or motion effects may be used to enhance safety using the methods and apparatus described herein.

In some embodiments, the pattern of illumination in the safe or the unsafe state may incorporate different elements, which may promote faster and more certain recognition of a change of states (e.g., from a safe state to an unsafe state). For example, a safe state may incorporate a pattern with at least a portion of time that includes substantially steady illumination intensity. In some examples, steady illumination may be continuous. In other embodiments, visibility may be enhanced by incorporating a pulse-width modulated operation mode. In some other embodiments, the illumination pattern may include strobing or rippling motion at a predetermined frequency (e.g., between about 0.1 to about 10 Hz, such as about 0.2, 0.3. 0.4, 0.5, 0.6, 0.7, 0.8, 0.9, 1, 2, 3, 4, 5, 6, 7, 8, or 9 Hz). In some further embodiments, the strobing frequency may be modulated, such as by a sweep over a predetermined range of frequencies (e.g., chirp).

Various embodiments may use more than one mode to communicate safety information from the spotter to the driver. Multiple modes may advantageously be detected more quickly by the driver and may therefore yield a reduced reaction time for stopping the vehicle. For example, the signal output module 125 may emit one more visual color indications (e.g., red or green) at locations generally in front of and to the each side of the driver. As the driver looks left, right, or to the front of the vehicle, at least one of the visual color indications may be within the driver's field of view.

In exemplary VMCS 100 configured to display steering or speed information in response to orientation of the HHSM 110, the spotter may also rotate the HHSM 110 so the CCM 120 correspondingly illuminates one of the arrows of the direction indicator and/or one or more of the IMs 130, 135 to guide the driver in the backing operation. In various examples, the left arrow on the cab control module display and the driver's side light indicator illuminate (e.g., greenish color) when the spotter rotates the handheld spotter module to the left. Accordingly, the driver may back vehicle toward the left. In some examples, the right arrow on the cab control module display and the passenger's side light indicator illuminate (e.g., greenish color) when the spotter rotates the handheld spotter module to the right. Accordingly, the driver may back the vehicle toward the right.

In some examples, the system does not come out of the system activation mode because the spotter does not depress the switch on the handheld spotter module. In various examples, the system transitions out of the safe mode in response to the spotter releasing the switch. The spotter may release the switch because of a perceived hazard and the spotter wishes to stop the maneuver operation or because the spotter drops the handheld spotter module. Until the cab control module receives a safe mode signal, the system will remain in the warning mode.

In some examples, the indicia of a safe state, unsafe state, or transition between states may further include a combination of communication modes. For example, some embodiments may incorporate a mechanical vibration (e.g., buzz) that may be perceived by the driver in proximity to the VMSS 105 and/or the spotter holding the HHSM 110. Such mechanical feedback, in combination with direct and/or indirect visual communication modes, and/or audible communication modes, may substantially enhance delivery of critical safety information under various conditions (e.g., poor visibility due to sun glare, high ambient noise due to mechanical equipment such as chain saws, or the like) during vehicle maneuvers.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A system to communicate safety information from a spotter to a vehicle driver during a vehicle maneuver, the system comprising:

a spotter module comprising a handheld unit operable by a spotter to communicate safety information to a driver operating a vehicle during a maneuver of the vehicle, wherein the spotter module comprises:

(a) a switch module arranged to be in a first state when not actively operated by a spotter, and further arranged to be in a second state when actively operated by the spotter; and, (b) an illumination module operable to illuminate the spotter module to project visible communication signals from the spotter to the driver in response to the switch module being in the second state;

a wireless module to receive status signals from the spotter module via a wireless communication link, the status signals including information indicative of whether the switch module is in the second state;

a plurality of vehicle-mounted indicator devices for communicating to the driver safety information relating to movement of the vehicle; and, a vehicle-mounted control module arranged to control operation of the indicator devices, wherein the control operations are responsive to the received signals from the spotter module, wherein the first state corresponds to an indication to stop the maneuver, and the second state corresponds to an indication to the driver to proceed with the maneuver.

2. The system of claim 1, wherein the system further comprises an orientation detection module operable to detect an orientation of the spotter module.

3. The system of claim 2, wherein the orientation module is further operable to detect an angular orientation of the spotter module that substantially exceeds a predetermined angle with respect to a substantially vertical orientation.

4. The system of claim 3, wherein the control module is further arranged to control the operation of vehicle-mounted indicator devices to indicate a directional message in response to the angular orientation detected by the orientation module.

5. The system of claim 2, wherein the illumination module controls the illumination of the spotter module in response to the angular orientation detected by the orientation module.

6. The system of claim 1, wherein the illumination module is sufficiently visible to be capable of being readily detected by the driver when the illumination module illuminates the spotter module, and the spotter module is within a field of view of the driver.

7. The system of claim 1, wherein the illumination module is sufficiently visible to be capable of being readily detected by the driver of the vehicle when the driver and the spotter module are separated by a vertically-oriented plane that tangentially intersects a rear-most portion of the vehicle.

8. The system of claim 6, wherein the field of view of the driver comprises a field of view using a mirror disposed on the vehicle.

9. The system of claim 1, further comprising:

a second spotter module comprising a handheld unit to be carried by a second spotter to communicate safety information to the driver;

a second switch module associated with the second spotter module and arranged to be in a third state when not actively operated by a second spotter, and further arranged to be in a fourth state while actively operated by the second spotter;

an illumination module associated with the second spotter module, the second illumination module operable to cause illumination of the second spotter module to project visible communication signals from the spotter to the driver in response to the second switch module being in the fourth state; and, wherein the control module further operates in response to the state of the second switch module.

10. The system of claim 1, wherein the control module is further arranged to control the operation of vehicle-mounted indicator devices in response to voice information received from the spotter module.

11. The system of claim 1, further comprising a voice module associated with the spotter module and arranged to process voice signals from the spotter for transmission to the control module.

12. The system of claim 1, wherein the spotter switch module transitions from the second state to the first state substantially immediately after the spotter ceases active operation of the switch.

13. The system of claim 1, wherein the system further comprises at least one additional spotter module.

14. The system of claim 1, further comprising a base station disposable in a driver's compartment of the vehicle for removably securing the spotter module when not in use.

15. The system of claim 14, wherein the base station further comprises a charging module to transfer energy to the spotter module while the spotter module is releasably secured to the base module.

16. The system of claim 15, wherein the spotter module comprises a rechargeable energy storage module and a recharging interface to receive energy from the charging module when the spotter module is coupled to the base station.

17. The system of claim 1, further comprises a communication module operable to receive identifying information about a spotter module upon establishing a communication link with the spotter module.

18. The system of claim 1, further comprising an event recording module to store information about operational events to which the control module is responsive.

19. The system of claim 18, wherein the stored information comprises time-stamped information indicative of at least one state of the switch module.

20. The system of claim 18, wherein the stored information comprises identifying information relating to a spotter module in operational communication with the control module.

21. A method of communicating safety information from a spotter to a vehicle driver during a vehicle maneuver, the method comprising:

providing a spotter module comprising a handheld unit operable by a spotter to communicate safety information to a driver operating a vehicle during a maneuver of the vehicle, wherein the spotter module comprises:

(a) a switch module arranged to be in a first state when not actively operated by a spotter, and further arranged to be in a second state when actively operated by the spotter; and, (b) an illumination module operable to illuminate the spotter module to project visible communication signals from the spotter to the driver in response to the switch module being in the second state;

providing a wireless module to receive status signals from the spotter module via a wireless communication link, the status signals including information indicative of whether the switch module is in the second state;

providing a plurality of vehicle-mounted indicator devices for communicating to the driver safety information relating to movement of the vehicle; and, providing a vehicle-mounted control module arranged to control operation of the indicator devices, wherein the control operations are responsive to the received signals from the spotter module;

wherein the switch module is activated by a user upon determining that a vehicle trajectory path is clear of hazards, and wherein the first state corresponds to an indication to stop the maneuver, and the second state corresponds to an indication to the driver to proceed with the maneuver.

22. The method of claim 21, wherein one of the plurality of indicator devices comprises a direction indicator, wherein the orientation of the spotter module triggers the direction indicator.

23. The method of claim 22, wherein the direction indicator comprises a left arrow and a right arrow, wherein the orientation of the spotter module to the left illuminates the left arrow.

24. The method of claim 23, wherein the orientation of the spotter module to the right illuminates the right arrow.

* * * * *